US005501168A

United States Patent [19]

Zachary

[11] Patent Number: 5,501,168

[45] Date of Patent: Mar. 26, 1996

[54] ADJUSTABLE SISSY BAR DEVICE FOR A JET SKI

[76] Inventor: Timothy W. Zachary, 5612 Boca Raton Blvd., #163, Fort Worth, Tex. 76112

[21] Appl. No.: 258,545

[22] Filed: Jun. 10, 1994

[51] Int. Cl.[6] ..... B63B 17/00

[52] U.S. Cl. ..... 114/363; 114/270; 180/219

[58] Field of Search ..... 280/304.4; 180/219, 180/190; 114/270, 363; 297/215.12, 195.11

[56] References Cited

U.S. PATENT DOCUMENTS

| | | | |
|---|---|---|---|
| D. 328,054 | 7/1992 | Thorpe | D12/307 |
| 1,074,438 | 5/1919 | Kimpel | 297/215.12 |
| 1,190,828 | 7/1919 | Weed | 297/215.12 |
| 3,394,673 | 6/1967 | Hamori | D12/307 |
| 4,032,189 | 6/1977 | Benavente et al. | 280/304.4 |
| 4,466,660 | 8/1984 | Mabie | 297/215.12 |
| 4,475,770 | 10/1984 | Persons, II | 297/215.12 |
| 5,136,963 | 8/1992 | Zuzik | 114/363 |
| 5,282,437 | 2/1994 | Avillez de Basto | 114/345 |
| 5,320,059 | 6/1994 | Ikeda | 114/363 |

FOREIGN PATENT DOCUMENTS

| | | | |
|---|---|---|---|
| 0055288 | 3/1987 | Japan | 114/270 |
| 0090493 | 4/1991 | Japan | 114/270 |

*Primary Examiner*—Edwin L. Swinehart
*Attorney, Agent, or Firm*—Geoffrey A. Mantooth

[57] ABSTRACT

An adjustable sissy bar device for a watercraft such as a jet ski, is provided. A mounting member is coupled to the jet ski about the stern and below the seat of the jet ski. A bar mount is coupled to the yoke. A bar is provided located extending along the stern of the jet ski upwards behind the seat. The bar moves between an upper position, where it forms a backrest behind the jet ski, and a lower position, where it allows a rider to more easily reboard the watercraft from the stern. Removable lock pins extend through the mounting member and the bar to secure the bar in a selected vertical position. Plural vertically arranged apertures in the bar permit the bar to be secured in a plurality of vertical positions.

11 Claims, 2 Drawing Sheets

ADJUSTABLE SISSY BAR DEVICE FOR A JET SKI

FIELD OF THE INVENTION

The present invention relates to sissy bar devices, in particular, to an adjustable sissy bar device for a watercraft such as a jet ski.

BACKGROUND OF THE INVENTION

Jet skis are motorized water sport devices which are typically used for recreation, emergency rescue and lake patrol purposes on large, publicly accessible bodies of water, such as lakes. Many jet skis are designed to seat multiple persons on a tandem seat portion of the jet ski. A driver is seated at the front of the jet ski facing the controls with passengers seated in a row behind the driver.

The passenger seated at the back of a jet ski is vulnerable to falling backwards off the jet ski during operation of the jet ski. A passenger at the rear of the jet ski has little to hold onto while the jet ski is being operated. Typically, a rear passenger holds onto the person seated in front of them to keep from being dislodged from the jet ski. However, a rear passenger may be thrown from the jet ski since jet skis can accelerate quickly, are capable of making quick, sharp turns, and can attain relatively high rates of speed.

Fixed back rests have been attached to multiple passenger jet skis behind the seat to reduce the likelihood of a rear passenger falling backwards off the jet ski. Although a fixed back rest helps protect the rear passenger, it also hinders rider attempts to mount a jet ski, particularly if a rider is attempting to board the jet ski from within the water. Riders (both driver and passengers) often fall into the water from a jet ski during normal operation of the jet ski. For example, the jet ski may tip when a sharp turn is executed and may cause a rider to fall into the water. Boarding a jet ski from within the water is easiest from the rear of the jet ski since the jet ski does not tip much when boarded from the rear. However, a fixed back rest blocks reboarding attempts from the rear of a jet ski. The dislodged rider is faced with attempting to climb over the fixed back rest, or attempting to board the jet ski from the side. Climbing over a tall back rest is difficult because the rider presents a high center of gravity that makes the jet ski tippy. Side boarding is difficult because a jet ski will tip excessively towards the side the rider is attempting to board.

What is needed, therefore, is an adjustable back rest that extends upwards behind the seat of a jet ski when a rear passenger is seated on the jet ski to reduce the likelihood of the rear passenger falling backwards off the jet ski but which may be lowered when a rider needs to board the jet ski from the rear.

SUMMARY OF THE INVENTION

It is, therefore, an object of the present invention to provide an adjustable sissy bar device for a jet ski that is attached about the rear of the jet ski and may be adjusted between upper and lower positions.

The present invention provides a watercraft having a hull, a seat and a stern portion. There is a mounting member coupled to the stern portion. There is also a bar that is coupled to the mounting member by a connector. The connector allows the bar to move between a first position, where the bar extends upwardly relative to the seat so as to form a backrest, and a second position, where the bar extends below the seat.

In another aspect, the present invention provides a sissy bar device that includes a yoke that is coupled to a jet ski extending across the stern of the jet ski beneath a seat portion of the jet ski. A slide bar mount couples the yoke and extends transverse to the yoke. The slide bar mount is structured and arranged to receive a slide bar. The slide bar has parallel first and second slide bar legs which are coupled by an upper portion of the slide bar, which extends between the first and second slide bar legs. The first and second slide bar legs extend downward from the upper portion through the slide bar mount transverse to the yoke. The first and second slide bar legs may slide through the slide bar mount. The slide bar mount is structured and arranged to retain and support the slide bar in a plurality of vertical positions behind the seat portion of the jet ski.

In one aspect of the invention, the first slide bar leg has a plurality of vertically arranged first lock pin receiving apertures extending therethrough. The second slide bar leg has a plurality of vertically arranged second lock pin receiving apertures extending therethrough. The second lock pin receiving apertures are located in the second slide bar leg aligned with and opposing the first lock pin receiving apertures in the first slide bar leg. The slide bar mount has at least one first mount aperture and at least one second mount aperture. The first mount aperture may be aligned with a first lock pin receiving aperture and the second mount aperture may be aligned with a second lock pin receiving aperture. A first lock pin removably extends through a first lock pin receiving aperture and the first mount aperture to secure the first slide bar leg to the slide bar mount, and a second lock pin removably extends through a second lock pin receiving aperture to secure the second slide bar leg to the slide bar mount.

The vertically adjustable slide bar of the sissy bar of the present invention may be adjusted to a plurality of vertical positions behind the seat of a jet ski. The slide bar may be adjusted upwards to provide a back rest for a rear passenger on the jet ski which helps prevent the rear passenger from falling off of the jet ski. The slide bar may also be lowered so that a person in the water next to the jet ski may board the jet ski from the rear of the jet ski without undue interference from the sissy bar.

DESCRIPTION OF THE PREFERRED EMBODIMENTS

Figure 1:
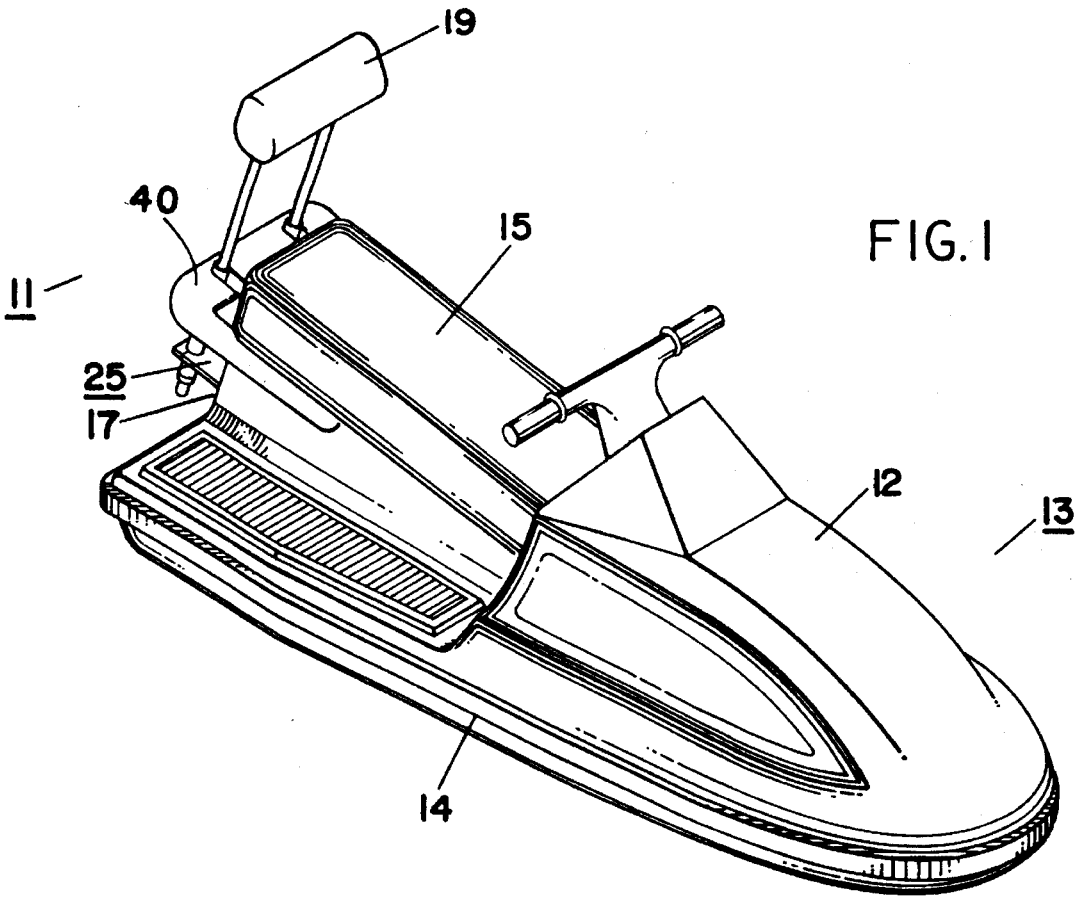
FIG. 1 is a perspective view of a jet ski incorporating the sissy bar of the current invention, in accordance with a preferred embodiment.

Referring now to FIG. 1, the sissy bar 11 of the present invention is shown positioned on a conventional, commercially available jet ski device 13. The jet ski 13 is a motorized water sport device having a hull 12 with a waterline 14. The jet ski also has a seat area 15 on which persons using jet ski 13 may sit. The seat bears on the hull 12 and is of the tandem type. The sissy bar 11 is attached about the stern 17 of the jet ski 13 extending upwards behind the seat area 15 of the jet ski 13. The sissy bar 11 serves to prevent passengers sitting directly in front of the sissy bar 11 from falling off of the back of the jet ski 13 while the jet ski is in motion. The sissy bar 11 includes a cushion 19 so that the sissy bar may also provide a back rest to passengers sitting in the rear portion of the seat area 15 of the jet ski.

Figure 2:
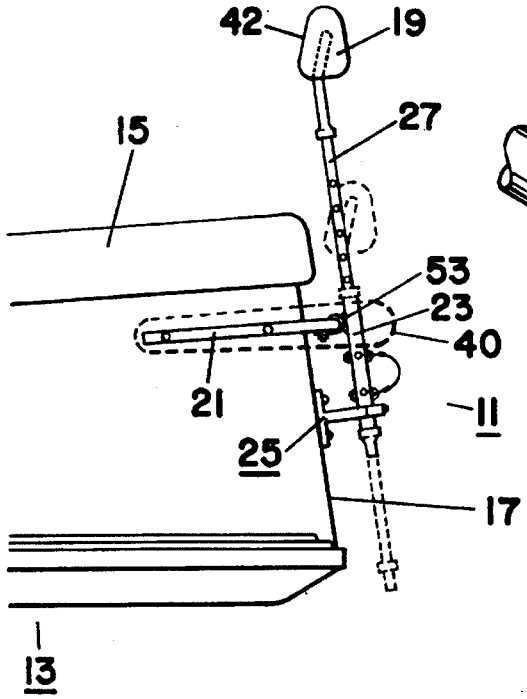
FIG. 2 is a side view of the sissy bar mounted to the aft end of the jet ski, shown with the sissy bar in the extended position in solids lines and with the sissy bar in a retracted or stowed position in dashed lines.

As shown in FIG. 2, the sissy bar 11 may be secured in plural positions so that the sissy bar may be adjusted higher (solid line) and lower (dashed line) relative to the seat portion 15 of the jet ski. The sissy bar 11 may be adjusted to higher positions to accommodate taller riders and may be adjusted to lower positions for shorter riders. Furthermore, the sissy bar 11 can be lowered to a lowest position so that a rider who has fallen off the jet ski 13 into the water can climb onto the seat portion 15 from behind the jet ski over the sissy bar 11 without interference from the sissy bar 11. Therefore, a rider who has fallen off is not required to attempt to reboard the jet ski from the side, which can be difficult since jet skis tend to tip easily.

Figure 3:
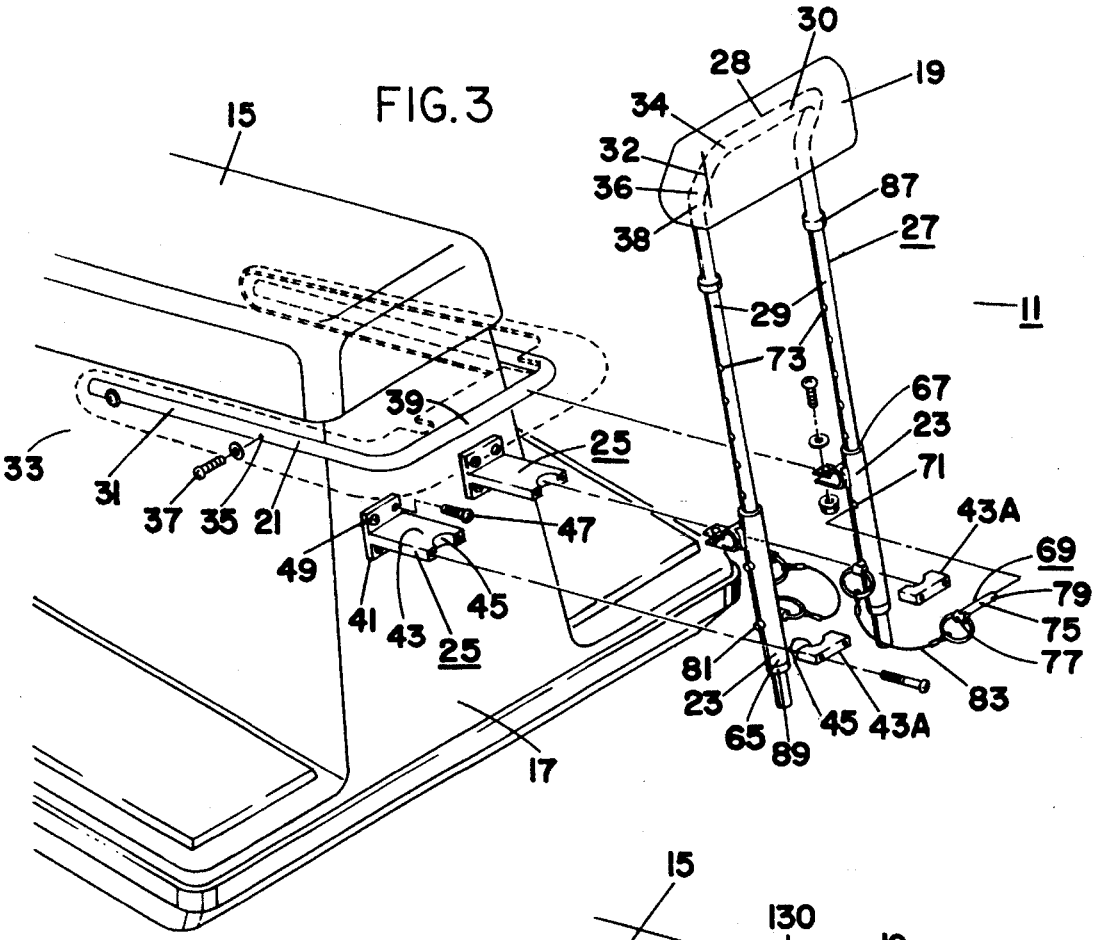
FIG. 3 is a exploded view of the sissy bar and the aft end of a jet ski.

As shown in FIGS. 2 and 3, the sissy bar 11 is comprised of a yoke 21, mounting tubes 23, support brackets 25, a slide bar 27, and the cushion 19. The yoke 21 and support brackets 25 secure the mounting tubes 23 to the jet ski. The mounting tubes 23 are coupled to the yoke 21, and, in conjunction with the support brackets 25, slidably accept and support the slide bar 27. The slide bar 27 extends along the stern 17 of the jet ski from a location above and behind the seat portion 15 through the mounting tubes 23 and the support brackets 25. The cushion is located about the slide bar 27 upwards and behind the seat portion 15.

Referring now to FIG. 3, the slide bar 27 comprises a cross bar 28 extending transversely between and coupling cylindrical slide bar legs 29. The slide bar legs 29 extend through the mounting tubes 23, and are slidably supported therein. The slide bar legs 29 extend upwards along the stern 17 to couple the cross bar 28 which is located behind seat portion 15 of the jet ski. The slide bar 27 may be positioned so that the cross bar 28 and the upper portions of the slide bar legs 29 may support the back of a person sitting in the rear portion of the seat area 15.

In a preferred embodiment, the cross bar 28 has a center portion 30 with arms 32 integrally coupled to each end 34 of the center portion 30 extending transverse to the center portion 30 so that the cross bar 28 has a "U" shape. Ends 36 of each arm 32 integrally couple the upper ends 38 of the slide bar legs 29, respectively, so that the arms 32 extend transverse to the slide bar legs 29, respectively. The arms 32 extend from the respective slide bar legs 29 to the center portion 30 rearwards relative to the seat portion 15 of the jet ski 13. The rearwardly located center portion 30 may be easily grasped by a rider who has fallen into the water in order to pull themselves back onto the jet ski. The aft side of the cushion 19 can be provided with an opening to facilitate the grasping of the cross bar 28.

The cushion 19 is located over the cross bar 28 and the upper ends 38 of the slide bar legs 29. The cushion is formed of a pliant, cushion material such as foam rubber covered by a water resistant plastic or cloth material. The cushion 19 is molded onto the cross bar 28. As shown in FIG. 2, a face 42 of the cushion 19 is positioned transverse to the seat portion 15 of the jet ski 13 to support the back of a rider.

Referring back to FIG. 3, the yoke 21 and the support brackets 25 are mounted to the jet ski 13 and secure the sissy bar 11 to the jet ski. The yoke 21 is formed of a cylindrical metal or plastic tube bent into a U-shape. Arm portions 31 of the yoke 21 extend along the sides 33 of the jet ski below the seat area 15. Two bolt receiving apertures 35 extend through each arm portion 31 facing the sides 33 of the jet ski. Bolts 37 extend through the sides 33 of the jet ski 13 and the bolt receiving apertures 35 in the arm portions 31. The bolts 37 secure the yoke 19 to the jet ski 13, being threadably coupled to nuts located inside of the hull of the jet ski. The nuts can be accessed by lifting up the seat 15.

Rear portion 39 of the yoke 21 integrally couples each arm portion 31 and extends transversely between the arm portions across the stern 17 of the jet ski 13 beneath the seat area 15. Cowling 40 may be placed over the yoke 21 to protect passengers of the jet ski 13 from sharp edges and to improve the appearance of the jet ski. The cowling 40 can extend down to cover the mounting tubes 23 and the brackets 25.

The support brackets 25 are mounted to the stern 17 of the jet ski 13 below the rear portion 39 of the yoke 21. Each support bracket 25 has a flat base 41 and a guide member 43 that is coupled to the base 41 and extends transverse to the base. In a preferred embodiment, each support bracket 25 has a "T" shape. The guide member 43 of each support bracket 25 has a circular guide aperture 45 centered in the guide member 43. The guide member bifurcates at the opening 45 so as to form an outer piece 45A. This arrangement allows the mounting tubes 23 to be received and clamped into the guide member 45. The outer piece 43A is bolted to the guide member 43.

The support brackets 25 are positioned on the stern 17 so that the slide bar 27 may be centered along the back of the jet ski 13 and so that the mounting tubes 23 may extend from the support brackets 25, respectively, upwards past the yoke 21. Each support bracket 25 is located on the stern 17 spaced vertically below the yoke 21 slightly less than the length of the mounting tubes 23 so that the mounting tubes may be located on the respective support brackets 25 extending upwardly past the yoke 21.

The base 41 of each support bracket 25 is bolted to the stern 17 of the jet ski 13 to secure the support bracket 25 to the jet ski. Bolts 47 extend through the stern 17 of the jet ski 13 and bolt receiving apertures 49 in the base 41 of each respective support bracket 25. The bolts 47 are secured by nuts inside of the hull of the jet ski.

Figure 4:
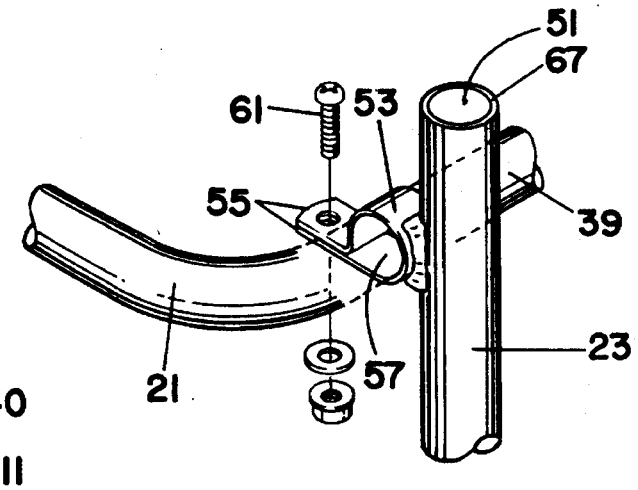
FIG. 4 is a perspective closeup view of the mounting arrangement.

The mounting tubes 23 slidably secure the slide bar 27 to the yoke 21. Each mounting tube 23 is coupled to the rear portion 39 of the yoke 21 and is oriented transverse to the yoke 21. As shown in FIG. 3 and 4, each mounting tube 23 is a straight cylindrical metal or plastic tube having an inner bore 51 extending through the tube along the longitudinal axis of the tube. The inner bore 51 has a diameter that is slightly larger than the diameter of the slide bar leg 29.

Referring back to FIG. 3, the slide bar legs 29 are located extending through the inner bore 51 of the mounting tubes 23, with the cross bar 28 located above the mounting tubes. The slide bar legs 29 may slide within the mounting tubes 23 so that the vertical position of the slide bar 27 may be changed along the stern 17 of the jet ski 13 relative to the mounting tubes, the yoke 21, and the seat portion 15 of the jet ski 13.

The mounting tubes 23 may be fixedly or adjustably coupled to the yoke 21. In one embodiment, the mounting tubes 23 are fixedly coupled to the yoke 21 by being welded or otherwise permanently secured to the yoke 21.

In another embodiment, the mounting tubes 23 are adjustably coupled to the yoke 21 so that the angle at which the mounting tubes extend relative to the yoke may be adjusted to accommodate jet skis having differently sloped sterns 17. As shown in FIG. 4, clamps 53 may be used to adjustably couple each mounting tube 23, to the yoke 21. Each clamp 53 is welded to its respective mounting tube 23 with clamp prongs 55 and clamp bore 57 located extending away from its respective mounting tube. Each clamp 53 is oriented on its respective mounting tube 23 so that the rear portion 39 of the yoke 21 may fit into the clamp bore 57 through a gap between the clamp prongs 55 when the mounting tube is correctly positioned on the jet ski 13. Each clamp 53 is installed onto the rear portion 39 of the yoke 21 by locating the yoke into the gap and pushing the clamp onto the yoke, which forces the prongs 55 apart and locates the yoke into the clamp bore 57. The angle of the mounting tube 23 relative to the rear portion 39 of the yoke 21 may be adjusted to accommodate the slope of the stern 17 by rotating the mounting tube and its respective clamp 53 about the rear portion 39 of the yoke 21 located in the clamp bore 57. The mounting tube 23 is secured at a desired angle relative to the yoke 21 by locating clamp bolt 61 through the prongs 55 and tightening the bolt 61 thereby tightening the clamp about the yoke.

Referring back to FIG. 3, the lower end portions 65 of the mounting tubes 23 are located in the support brackets 25. The upper end portion 67 of each mounting tube 23 is located above the yoke 21 and below the seat portion 15 of the jet ski 13.

Referring still to FIG. 3, the vertical position of the slide bar 27 may be adjusted by adjusting the position of the slide bar legs 29 in the mounting tubes 23. Retaining pins 69 fit through aligned height adjustment apertures 71 in the mounting tubes 23 and through the slide bar 27 to secure the slide bar in a desired vertical position. The slide bar legs 29 have a series of vertically arranged height adjustment apertures 73 extending therethrough to allow the slide bar 27 to be secured in several vertical positions. The height adjustment apertures 71 and 73 extend through the mounting tubes 23 and through the slide bar legs 29 respectively, transverse to the longitudinal axis of each mounting tube 23 and each slide bar leg 29, respectively. The height adjustment apertures 71 and 73 are aligned in the mounting tubes 23 and the slide bar legs 29, respectively, so that each height adjustment aperture 71 in a mounting tube 23 is located directly opposite a corresponding height adjustment aperture 71 in the opposite mounting tube 23, and each height adjustment aperture 73 in a slide bar leg 29 is located directly opposite a corresponding height adjustment aperture 73 in the opposite slide bar leg 29. The slide bar 27 is located in a desired vertical position by sliding the slide bar legs 29 through the mounting tubes 23 until the height adjustment apertures 71 in the mounting tubes 23 are aligned with a set of height adjustment apertures 73 in the respective slide bar legs 29 at the desired vertical position.

The retaining pins 69 secure the slide bar 27 in the desired vertical location by being located through aligned height adjustment apertures 71 and 73 in the mounting tubes 23 and slide bar legs 29 respectively. Each retaining pin 69 comprises a cylindrical shaft 75 having a head 77 integrally coupled thereto. The shaft 75 has a diameter slightly smaller than the diameter of the height adjustment apertures 71 and 73 so that the shaft may fit through the height adjustment apertures. The head 77 is too large to fit through the height adjustment apertures 71 and 73. The shaft 75 is sufficiently long to extend through a slide bar leg 29 and into a mounting tube 23 through the height adjustment apertures 71 and 73. The slide bar 27 is secured in a desired vertical position by locating the shaft 75 of each retaining pin 69 through a height adjustment aperture 71 in a respective mounting tube 23 and through a height adjustment aperture 73 of a respective slide bar leg 29 so that the head 77 of the pin 69 is located adjacent to the mounting tube 23 and the shaft 75 extends through the mounting tube 23 into the slide bar leg 29.

Each retaining pin 69 has a locking mechanism 79 located near the end 81 of the shaft 75 to lock the pin 69 in place. In a preferred embodiment, the locking mechanism 79 is a conventional detent ball and spring mechanism. The ball secures the retaining pin 69 in the height adjustment apertures 71 and 73 since the ball and shaft 75 together are too large to fit through the height adjustment apertures 71 and 73. The retaining pin 69 may easily be inserted into or removed from the height adjustment apertures 71 and 73, however, because the ball is depressed into the shaft by the apertures when force is applied to remove the pin 69 from, or insert the pin into, the height adjustment apertures.

In a preferred embodiment, each slide bar leg 29 and its respective mounting tube 23 are secured in the desired vertical position by two spaced apart retaining pins 69 located in two sets of height adjustment apertures 71 and 73. The two retaining pins 69 are fixedly joined together by a wire 83. The wires 83 are located between the slide bar legs 29 adjacent to each other when the retaining pins 69 lock the slide bar 27 in place. The close proximity of the wires 83 enables a rider to easily remove the retaining pins 69 to change the vertical position of the slide bar 27 by merely grasping the wires and squeezing them together, thereby pulling the retaining pins 69 out of the height adjustment apertures 71 and 73. The easily grasped loop portions of the wires 83 are especially useful to a rider who has fallen into the water so the rider may easily remove the retaining pins 69 to lower the slide bar 27 so that the rider may board the jet ski 13 over the slide bar 27. A wire (not shown) can be used to couple the wires 83 to the yoke.

Upper and lower stops 87 and 89 respectively,are attached to the slide bar legs 29 to limit the vertical movement of the slide bar 27. Each stop 87 and 89 is a washer located about a respective slide bar leg 29 and securely attached to the slide bar leg. In a preferred embodiment, the stops 87 and 89 are welded to the legs 29.

The lower stops 89 are located about the slide bar legs 29 below the mounting tubes 23 The lower stops 89 prevent the slide bar 27 from being raised to a position where the slide bar legs 29 are located out of the mounting tubes 23.

The upper stops 87 are located about the slide bar legs 29 above the upper ends 67 of the mounting tubes 23. The upper stops 87 have a diameter that is wider than the diameter across the upper end 67 of each mounting tube 23. The upper stops 87 prevent the slide bar 27 from being lowered too far.

Figure 5:
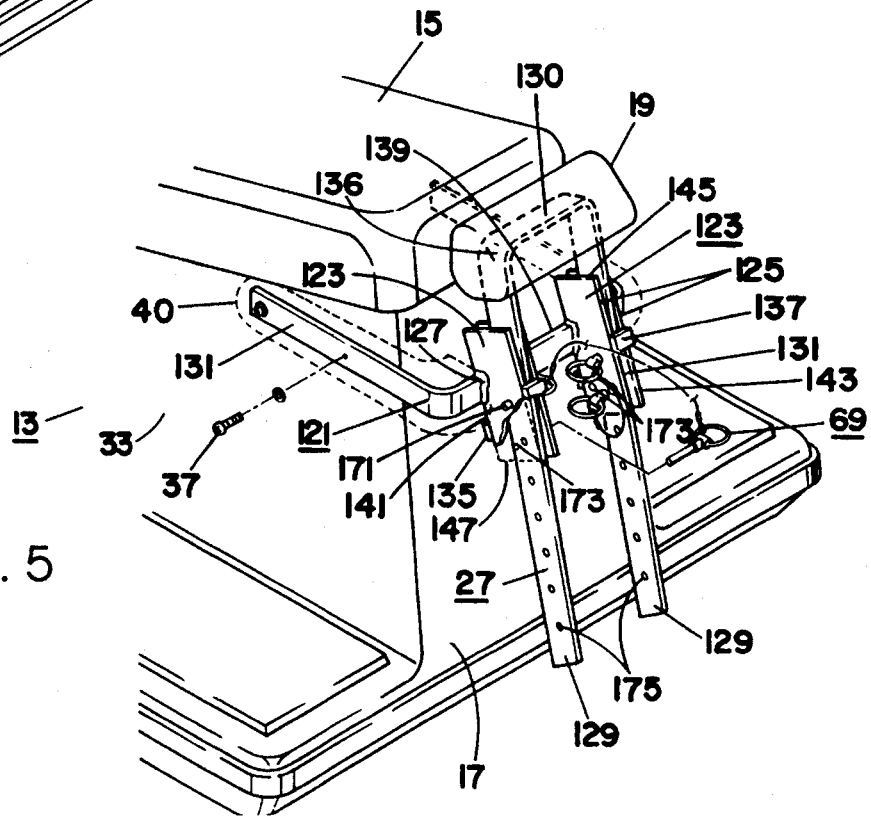
FIG. 5 is a perspective view of a second embodiment of the sissy bar of the current invention located on a jet ski.

In FIG. 5, there is shown the sissy bar 11 of the present invention, in accordance with another embodiment. Like numbers in the figures designate similar parts and components. The sissy bar 11 is comprised of a yoke 121, a slide bar 27 and mounting boxes 123. The yoke 121 couples the slide bar 27 to the jet ski 13. The slide bar 27 extends upwards behind the seat portion 15 of the jet ski 13 to provide a back rest to the passenger in the rear portion of the seat 15, and to prevent the passenger from falling off of the back of the jet ski. The mounting boxes 123 secure the slide bar 27 to the yoke 121. The slide bar 27 is slidably located in the mounting boxes 123 so that the slide bar 27 may be adjusted to different vertical positions behind the seat portion 15 of the jet ski 13. The yoke 121 and the slide bar 27 are formed of metal, fiberglass or plastic flat bar material.

The slide bar 27 is comprised of a cross bar 130 extending transversely between and coupling slide bar legs 129. The slide bar legs 129 extend through the mounting boxes 123 respectively, and are slidably supported therein centered along the stern 17 of the jet ski. The slide bar legs 129 extend upwards along the stern 17 to the cross bar 130 which is located behind the seat portion 15 of the jet ski.

A cushion 19 is located over the cross bar 130 and the upper ends 136 of the slide bar legs 129. The cushion 19 has a slot (not shown) extending therethrough which receives the cross bar 130 and upper ends 136 of the slide bar legs 129 to secure the cushion on the slide bar 27. In the preferred embodiment, the cushion 19 is molded onto the cross bar 130. A face of the cushion is positioned transverse to the seat portion 15 of the jet ski to support the back of a rider.

The yoke 121 has arm portions 131 and a rear portion 139. The rear portion 139 extends transversely between and integrally couples to the arm portions 131. The arm portions 131 are located extending along the sides 33 of the jet ski 13 and are bolted thereto with bolts 37. The rear portion 139 is located extending across the stern 17 of the jet ski 13 beneath the seat portion 15. Cowling 40 may be located over the yoke 121 to protect passengers from sharp edges and to enhance the appearance of the sissy bar 11. The cowling 40 can extend to cover the mounting boxes 123.

Each mounting box 123 is formed of two parallel plates 125 mounted on the yoke 121 in a fixed, spaced apart relation with a gap 132 extending between the plates 125. The rear portion 139 of the yoke 121, an inner support block 135 and an outer support block 137 couple the plates 125 and secure the plates in their spaced apart relationship. The rear portion 139 of the yoke 121 is received and fixedly coupled in a notch 127 located in the inner edge 141 of each plate 125. Location of the notch 127 about the yoke 121 causes the plates 125 to be angled with respect to the yoke 121 so that the inner and outer edges 141 and 143 of the plates are angled from the vertical so as to extend roughly parallel to the stern 17 of the jet ski 13. The inner support block 135 couples the inner edges 141 of the plates 125 and extends transversely between the plates below the yoke 121. The outer support block 137 couples the outer edges 143 of the plates 125 and extends transversely between the plates centered along the length of the outer edges of the respective plates.

The mounting boxes 123 are positioned on the yoke to receive the sissy bar legs 129. Each mounting box 123 is spaced apart from the opposite mounting box 123 a distance equal to the spacing between the slide bar legs 129. The slide bar legs 129 extend through the mounting boxes 123 respectively, between the top and bottom edges 145 and 147 respectively, of each mounting box 123 through the gaps 132 in the mounting boxes. The mounting boxes 123 are positioned on the yoke 121 so that the slide bar 27 is centered along the stern 17 when the slide bar legs 129 are located extending through the mounting boxes 123.

The vertical position of the slide bar 27 may be adjusted by adjusting the position of the slide bar legs 129 in the mounting boxes 123. The slide bar legs 129 may slide through the gaps 132 in the mounting boxes 123 respectively, to adjust the vertical position of the slide bar 27 on the jet ski. Each slide bar leg 129 has a plurality of vertically spaced slide bar apertures 175 which are aligned opposite corresponding slide bar apertures 175 in the opposing slide bar leg. Retaining pins 69 extend across the gap 132 between the plates 125 of each mounting box 123 through upper and lower height adjustment apertures 171 and 173, respectively, in the mounting boxes, and the aligned slide bar apertures 175 in the slide bar legs 129 to lock the slide bar 27 in a vertical position. The upper and lower height adjustment apertures 171 and 173 are located extending through the plates 125 of each mounting box 123 near the top and bottom edges 145 and 147, respectively, of the mounting box. In a preferred embodiment, each slide bar leg 129 is located in position in its respective mounting box 123 by two retaining pins 69. The two retaining pins fit through the upper and lower height adjustment apertures 171 and 173 and are coupled together for easy removal.

Various jet ski models have sterns 17 of various angles. The angle of the slide bar 27 relative to the stern 17 and the yoke 21 may be adjusted as desired. Each mounting box 123 has plural lower height adjustment apertures 173 arranged along an imaginary line extending from the inner edge 141 to the outer edge 143. A single upper height adjustment aperture 171 extends through each mounting box 123 near the top edge 145 of the mounting box. The angle of the slide bar 27 may be adjusted by pivoting the slide bar 27 about the retaining pins 69 in the upper height adjustment apertures 171 to select lower height adjustment apertures 173 in the mounting boxes 123 located in a position corresponding to the desired slide bar angle. The retaining pins 69 are then placed through the selected lower height adjustment apertures 173 and the slide bar apertures 175 to lock the slide bar 27 in place.

Upper and lower stops 187 and 189, respectively, can be provided to limit the vertical movement of the slide bar 27. The slide bar 27 can be lowered to a lowest position below the seat portion 15 of the jet ski 13 so that a rider who has fallen off the jet ski into the water can climb over the slide bar onto the seat 15 from behind the jet ski with minimal interference from the slide bar.

Although the sissy bar of the present invention has been described as moving between a raised position (to provide back support to a rider) and a lowered position (to allow a rider to more easily reboard the jet ski from the stern) by a sliding tube or bar arrangement, other arrangements can be used. For example, the sissy bar can be pivotable between upper and lower positions. The slide bar 27 is coupled to the yoke 21 by a pivotable arrangement.

The foregoing disclosure and the showings made in the drawings are merely illustrative of the principles of this invention and are not to be interpreted in a limiting sense.

I claim:

1. A watercraft, comprising:

a) a yoke coupled to said watercraft, said yoke being located extending across a stem of said watercraft beneath a seat portion of said watercraft;

b) a slide bar mount coupled to said yoke extending transverse to said yoke, said slide bar mount being structured and arranged to slidably receive a slide bar;

c) a slide bar comprising an upper portion and first and second slide bar legs, said upper portion extending between and coupling parallel first and second slide bar legs, and said upper portion being adjustably located behind said seat portion of said watercraft, said first and second slide bar legs being located extending downward from said upper portion transverse to said yoke with said slide bar legs being slidably located extending through said slide bar mount;

d) said slide bar mount is structured and arranged to adjustably retain and support said slide bar in a plurality of vertical positions behind said seat portion of said watercraft.

2. The watercraft of claim 1, wherein:

a) said first slide bar leg has a plurality of vertically arranged first lock pin receiving apertures extending therethrough;

b) said second slide bar leg has a plurality of vertically arranged second lock pin receiving apertures extending therethrough, said second lock pin receiving apertures being located in said second slide bar leg aligned with and opposing said first lock pin receiving apertures in said first slide bar leg;

c) said slide bar mount includes at least one first mount aperture and at least one second mount aperture, where said first mount aperture may be aligned with a first lock pin receiving aperture of said first slide bar leg and said second mount aperture may be aligned with a second lock pin receiving aperture of said second slide bar leg;

d) a first lock pin removably extends through a first lock pin receiving aperture and said first mount aperture to secure said first slide bar leg to said slide bar mount;

e) a second lock pin removably extends through a second lock pin receiving aperture and said second mount aperture to secure said second slide bar leg to said slide bar mount.

3. The watercraft of claim 2, wherein:

a) a first handle couples said first lock pin where said first handle has a first loop of material coupled thereto, where said first loop of material may be grasped to remove said first lock pin from said first mount aperture and said first lock pin receiving aperture;

b) a second handle couples said second lock pin where said second handle has a second loop of material coupled thereto, where said second loop of material may be grasped to remove said second lock pin from said second mount aperture and said second lock pin receiving aperture.

4. The watercraft of claim 1, wherein:

a) said slide bar mount comprises first and second mounting receptacles for receiving said first and second slide bar legs respectively;

b) said first and second mounting receptacles are individually coupled to said yoke spaced apart to receive said first and second slide bar legs therein, respectively.

5. The watercraft of claim 4, wherein:

a) said first slide bar leg is cylindrical;

b) said second slide bar leg is cylindrical;

c) said first mounting receptacle is an elongated tube having a cylindrical first inner bore extending therethrough along the length of said first mounting receptacle;

d) said second mounting receptacle is an elongated tube having a cylindrical second inner bore extending therethrough along the length of said second mounting receptacle;

e) said first slide bar leg is slidably located extending through said first inner bore of said first mounting receptacle, said first inner bore having a diameter slightly greater than a diameter of said first slide bar leg;

f) said second slide bar leg is slidably located extending through said second inner bore of said second mounting receptacle, said second inner bore having a diameter slightly greater than a diameter of said second slide bar leg.

6. The watercraft of claim 5, further comprising:

a) a first clamp integrally coupled to said first mounting receptacle, said first clamp coupling said first mounting receptacle to said yoke, said first clamp and said first mounting receptacle being adjustably located about said yoke so that said first mounting receptacle may be adjusted to a plurality of transversely angled positions relative to said yoke;

b) a second clamp integrally coupled to said second mounting receptacle, said second clamp coupling said second mounting receptacle to said yoke, said second clamp and said second mounting receptacle being adjustably located about said yoke so that said second mounting receptacle may be adjusted to a plurality of transversely angled positions relative to said yoke.

7. The watercraft of claim 6, further comprising:

a) first and second support brackets coupled to said stem of said watercraft below said yoke;

b) said first support bracket has a first guide aperture extending therethrough positioned to receive said first slide bar leg therethrough;

c) said second support bracket has a second guide aperature extending therethrough positioned to receive said second slide bar leg therethrough;

d) said first mounting receptacle has a lower end located on and supported by said first support bracket;

e) said second mounting receptacle has a lower end located on and supported by said second support bracket.

8. The watercraft of claim 5, further comprising:

a) first and second support brackets coupled to said stem of said jet ski below said yoke;

b) said first support bracket has a first guide aperture extending therethrough positioned to receive said first slide bar leg therethrough;

c) said second support bracket has a second guide aperture extending therethrough positioned to receive said second slide bar leg therethrough;

d) said first mounting receptacle has a lower end located on and supported by said first support bracket;

e) said second mounting receptacle has a lower end located on and supported by said second support bracket.

9. The watercraft of claim 8, further comprising:

a) first and second upper stops coupled about said first and second slide bar legs, respectively, above said vertically arranged lock pin receiving apertures, said first and second upper stops extending radially outward from said first and second slide bar legs, respectively, where said first and second upper stops are wider than said first and second inner bores, respectively, of said respective first and second mounting receptacles;

b) first and second lower stops coupled about said first and second slide bar legs, respectively, below said vertically arranged lock pin receiving apertures, said first and second lower stops extending radially outward from said first and second slide bar legs, respectively, where said first and second lower stops are wider than said first and second inner bores, respectively, of said respective first and second mounting receptacles.

10. The watercraft of claim 4, wherein:

a) said first mounting receptacle is comprised of a first pair of parallel plates coupled to said yoke in a fixed spaced apart position having a gap extending therebetween;

b) said second mounting receptacle is comprised of a second pair of parallel plates coupled to said yoke in a fixed spaced apart position having a gap extending therebetween;

c) said first pair of parallel plates is located on said yoke to slidably receive said first slide bar leg in said gap between said first pair of plates;

d) said second pair of parallel plates is located on said yoke to slidably receive said second slide bar leg in said gap between said second pair of plates.

11. The watercraft of claim 10, wherein:

a) said first pair of plates of said first mounting receptacle has a pair of aligned first upper mount apertures, where each plate of said first pair of plates has a first upper mount aperture extending therethrough in an upper section of said plate;

b) said second pair of plates of said second mounting receptacle has a pair of aligned second upper mount apertures, where each plate of said second pair of plates has a second upper mount aperture extending therethrough in an upper section of said plate;

c) said first pair of plates of said first mounting receptacle has a plurality of pairs of aligned first lower mount apertures, where each plate of said first pair of plates has plural first lower mount apertures located extending along a lower section of said plate from a front of said plate towards a back of said plate;

d) said second pair of plates of said second mounting receptacle has a plurality of pairs of aligned second lower mount apertures, where each plate of said second pair of plates has plural second lower mount apertures extending along a lower section of said plate from a front of said plate towards a back of said plate;

e) said first mounting receptacle and said second mounting receptacle are positioned on said yoke with said first and second upper mount apertures aligned and with said first and second lower mount apertures aligned;

f) said first slide bar leg has a plurality of vertically arranged first lock pin receiving apertures extending therethrough;

g) said second slide bar leg has a plurality of vertically arranged second lock pin receiving apertures extending therethrough;

h) a first upper lock pin removably extends through said first upper mount apertures and a first lock pin receiving aperture to secure said first slide bar leg in said first mounting receptacle;

i) a second upper lock pin removably extends through said second upper mount apertures and a second lock pin receiving aperture to secure said second slide bar leg in said second mounting receptacle;

j) a first lower lock pin removably extends through a selected pair of first lower mount apertures and a first lock pin receiving aperture secure said first slide bar leg in said first mounting receptacle said pair of first lower mounting apertures being selected to locate said slide bar at a desired angle with respect to said yoke;

k) a second lower lock pin removably extends through a selected pair of second lower mount apertures and a second lock pin receiving aperture to secure said second slide bar leg in said second mounting receptacle, said pair of second lower mounting apertures being selected to locate said slide bar at a desired angle with respect to said yoke.

* * * * *